US008764249B2

(12) United States Patent
Toda et al.

(10) Patent No.: US 8,764,249 B2
(45) Date of Patent: Jul. 1, 2014

(54) LAMP DEVICE AND LUMINAIRE

(75) Inventors: Masahiro Toda, Yokosuka (JP); Shigeru Osawa, Yokosuka (JP); Yuichiro Takahara, Yokosuka (JP); Hiroshi Matsushita, Yokosuka (JP); Junichi Kimiya, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 144 days.

(21) Appl. No.: 13/423,140

(22) Filed: Mar. 16, 2012

(65) Prior Publication Data

US 2012/0243237 A1 Sep. 27, 2012

(30) Foreign Application Priority Data

Mar. 25, 2011 (JP) ..... 2011-068965

(51) Int. Cl.
*F21V 11/00* (2006.01)

(52) U.S. Cl.
USPC ..... 362/306; 362/351; 313/318.01

(58) Field of Classification Search
USPC ..... 362/306, 351; 313/318, 318.01
See application file for complete search history.

(56) References Cited

U.S. PATENT DOCUMENTS

2006/0227558 A1 10/2006 Osawa et al.
2011/0058387 A1 3/2011 Matsunaga et al.

FOREIGN PATENT DOCUMENTS

EP 2-124-255 A1 11/2009
EP 2-450-616 A1 9/2012
JP 2010-262781 11/2010
WO 2010090314 A1 8/2010

OTHER PUBLICATIONS

European Search Report Patent Application No. 12160083.7 dated Jun. 26, 2013.

*Primary Examiner* — Joseph L Williams
(74) *Attorney, Agent, or Firm* — Patterson + Sheridan LLP

(57) ABSTRACT

According to one embodiment, a lamp device includes a light-emitting module including a semiconductor light-emitting element, a lighting circuit to light the semiconductor light-emitting element, and a housing to house the light-emitting module and the lighting circuit. The housing includes a case including a holder part to hold the light-emitting module, and a cap member fixed to the case by a fixing unit. The light-emitting module is sandwiched and fixed between the holder part and the cap member.

6 Claims, 6 Drawing Sheets

LAMP DEVICE AND LUMINAIRE

INCORPORATION BY REFERENCE

The present invention claims priority under 35 U.S.C. §119 to Japanese Patent Application No. 2011-068965 filed on Mar. 25, 2011. The content of the application is incorporated herein by reference in their entirety.

FIELD

Embodiments described herein relate generally to a lamp device using a semiconductor light-emitting element and a luminaire using the lamp device.

BACKGROUND

Hitherto, as a lamp device using a semiconductor light-emitting element, there is, for example, a flat lamp device using a GX53-type cap.

In the lamp device, a light-emitting module including the semiconductor light-emitting element, a lighting circuit to light the semiconductor light-emitting element, a reflector to control luminous intensity distribution of light from the semiconductor light-emitting element and the like are housed in a housing.

The light-emitting module is positioned in the housing in order to unify optical characteristics, and is required to be pressed and fixed to the housing in order to improve thermal radiation properties. However, for that purpose, the light-emitting module is required to be fixed to the housing by using fixing components such as a holder and plural screws, and therefore, there is a problem that the number of components is large and the number of assembling steps increases.

An exemplary embodiment described herein provides a lamp device in which the number of components can be reduced and an assembling property can be improved, and a luminaire using the lamp device.

DETAILED DESCRIPTION

In general, according to one embodiment, a lamp device includes a light-emitting module including a semiconductor light-emitting element, a lighting circuit to light the semiconductor light-emitting element, and a housing to house the light-emitting module and the lighting circuit. The housing includes a case including a holder part to hold the light-emitting module, and a cap member fixed to the case by a fixing unit. The light-emitting module is sandwiched and fixed between the holder part and the cap member.

According to the lamp device, since the light-emitting module is held by the holder part, and is sandwiched and fixed between the holder part and the cap member, a fixing part to fix the light-emitting module to the cap member is not required, the number of components can be reduced and an assembling property can be improved.

Next, a first embodiment will be described with reference to FIG. 1 to FIG. 5.

Figure 1:
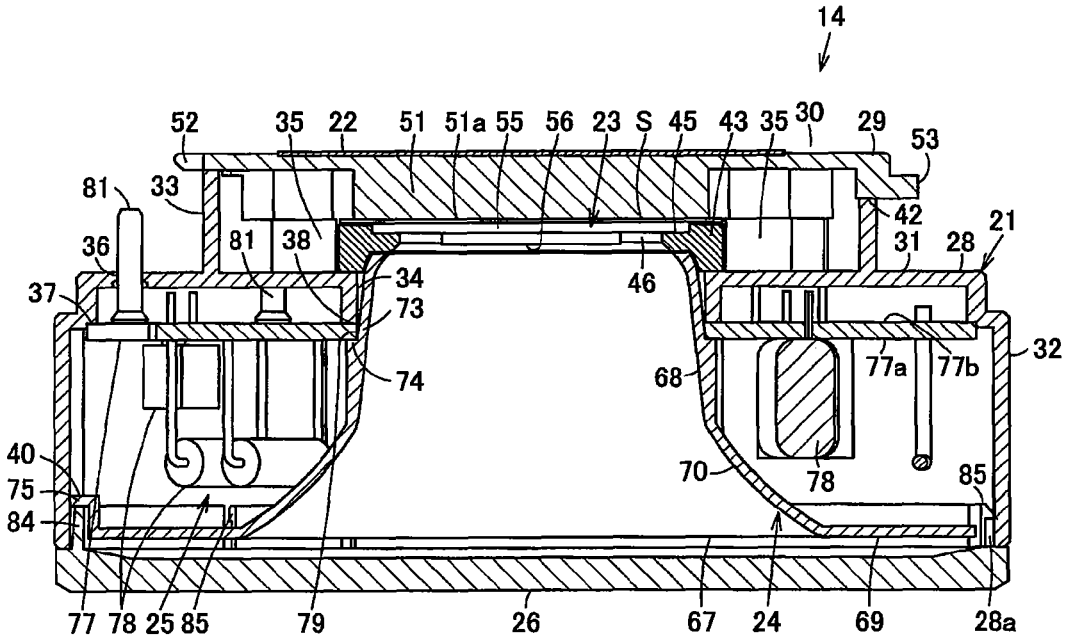
FIG. 1 is a sectional view of a lamp device of a first embodiment.
Figure 2:
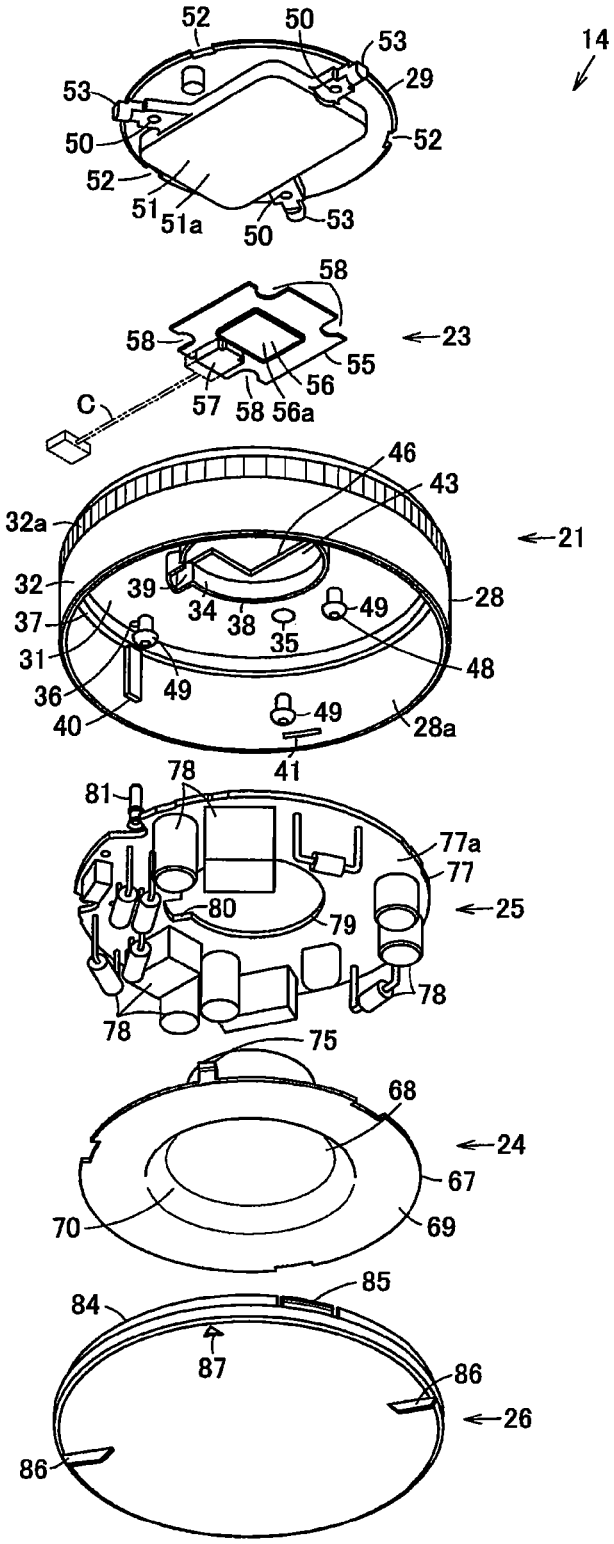
FIG. 2 is a perspective view of a decomposed state of the lamp device.
Figure 3:
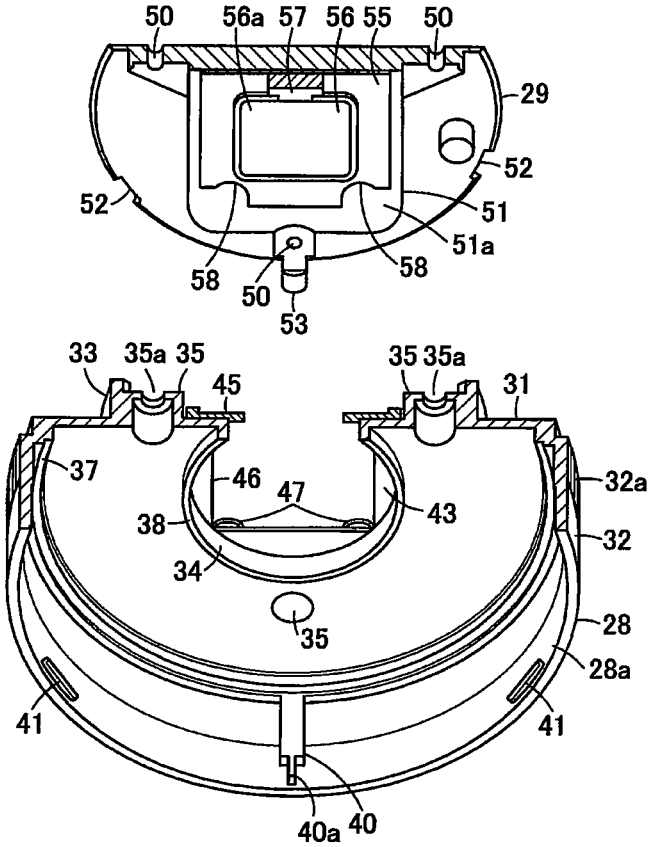
FIG. 3 is a perspective view in which part of a case and a cap member of the lamp device are cut away.
Figure 4:
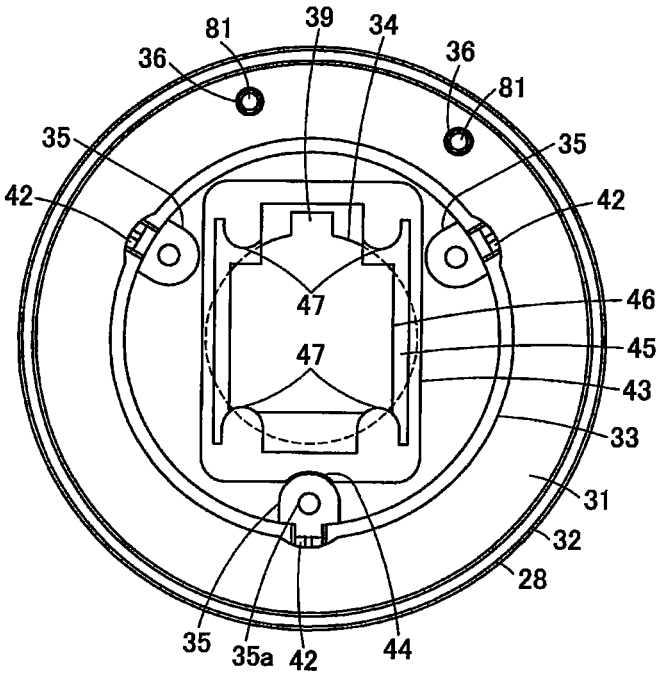
FIG. 4 is a plan view of the case of the lamp device.
Figure 5:
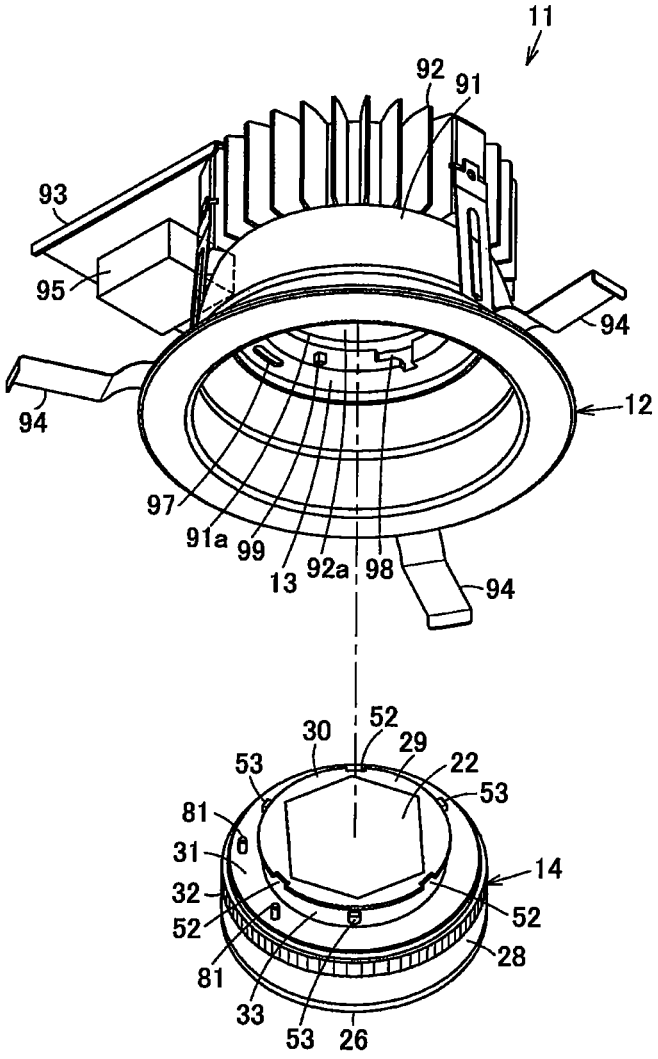
FIG. 5 is a perspective view of a luminaire using the lamp device.

As shown in FIG. 5, a luminaire 11 is an embedded luminaire such as a downlight, and is installed to be embedded in a circular embedding hole provided in a ceiling plate or the like. The luminaire 11 includes an equipment main body 12, a socket 13 attached to the equipment main body 12, and a flat lamp device 14 detachably mounted on the socket 13.

First, the lamp device 14 will be described. As shown in FIG. 1 to FIG. 4, the lamp device 14 includes a flat cylindrical housing 21, a thermal conductive sheet 22 attached to the upper surface of the housing 21, a light-emitting module 23 housed in the housing 21, an optical component 24, a lighting circuit 25, and a translucent cover 26 attached to the lower surface of the housing 21.

The housing 21 includes a cylindrical case 28, and a disk-shaped cap member 29 attached to the upper surface of the case 28. A cap 30 having a specified standard size is constructed of the upper side of the case 28 and the cap member 29.

The case 28 is made of, for example, a synthetic resin having an insulating property, and includes a flat plate part 31 as the upper surface, a cylindrical peripheral surface part 32 protruding downward from a peripheral part of the flat plate part 31, and a cylindrical protrusion part 33 protruding upward from the upper surface of the flat plate part 31. An opening 28*a* is formed in the lower surface of the case 28.

A circular optical component insertion hole 34 is formed at the center of the flat plate part 31 of the case 28. Plural bosses 35 including screw insertion holes 35*a* are formed around the optical component insertion hole 34 of the flat plate part 31. Further, a pair of lamp pin insertion holes 36 are formed on a peripheral edge part of the flat plate part 31. The plural bosses 35 protrude from the upper surface of the flat plate part 31 and inside the cylindrical protrusion part 33. An annular outer peripheral side board support part 37 and an annular inner peripheral side board support part 38 to support the lighting circuit 25 (circuit board) are respectively formed at a peripheral part of the flat plate part 31 and an edge part of the optical component insertion hole 34. A wiring path 39 is formed at one place of the inside board support part 38.

Plural optical component support parts 40 to support the optical component 24 are formed on an inner peripheral surface of the peripheral surface part 32 of the case 28, and plural projections 41 are formed in the vicinity of the opening 28*a*. A rib 40*a* to stop the rotation of the optical component 24 is formed at one of the optical component support parts 40. A concave and convex part 32*a* is formed on an outer peripheral surface of the peripheral surface part 32 and at an upper side thereof.

Plural key fitting grooves 42 are formed in a circumferential direction at equal intervals in a tip edge of the protrusion part 33 of the case 28.

A holder part 43 to hold the light-emitting module 23 is arranged on the upper surface of the flat plate part 31 of the case 28 and inside the protrusion part 33. In this embodiment, the holder part 43 formed separately from the case 28 is attached to the case 28.

The holder part 43 is made of, for example, a synthetic resin having an insulating property and is formed into a rectangular frame shape, and a recessed part 44 fitted to one of the bosses 35 of the case 28 is formed at an end in the longitudinal direction. The holder part 43 is fitted in between an inner wall surface of the protrusion part 33 and the plural bosses 35, contacts the flat plate part 31 and is positioned and held. Incidentally, the holder part 43 may be merely fitted in the case 28, may be press-inserted and fixed in the case 28, or may be adhered and fixed to the case 28 by an adhesive.

A concave part 45 in which the light-emitting module 23 is fitted and held is formed in the holder part 43. An opening 46 is formed in an inside area of the concave part 45, and positioning projections 47 to position the light-emitting module 23 are formed at plural places of a peripheral part of the concave part 45 and at four corners of the concave part 45. In a state where the light-emitting module 23 is fitted in the concave part 45, a part of the light-emitting module 23 protrudes from the concave part 45.

The cap member 29 is made of, for example, a metal such as an aluminum die cast, ceramic or material such as resin excellent in thermal conductivity and is formed into a disk shape. The diameter of the cap member 29 is formed to be larger than the diameter of the protrusion part 33 of the case 28. A peripheral part of the cap member 29 protrudes from an outer peripheral surface of the protrusion part 33 of the case 28.

Plural attachment holes 50 in which plural screws 49 as fixing units 48 are threaded through the screw insertion holes 35*a* of the plural bosses 35 of the case 28 are formed in the lower surface peripheral part of the cap member 29. The case 28 and the cap member 29 are tightened and fixed by the plural screws 49 in the state where the light-emitting module 23 is sandwiched between the holder part 43 of the case 28 and the cap member 29.

A light-emitting module attachment part 51 protruding from the lower surface of the cap member 29 is integrally formed at the center of the lower surface of the cap member 29. A flat contact surface 51*a* which the light-emitting module 23 contacts is formed on the lower surface of the light-emitting module attachment part 51.

Plural key grooves 52 and plural keys 53 are alternately formed at equal intervals in the circumferential direction in the peripheral part of the cap member 29. When the cap member 29 is combined with the case 28, the respective keys 53 are fitted to the respective key fitting grooves 42 of the protrusion part 33 and protrude from the outer peripheral surface of the protrusion part 33. Incidentally, in this embodiment, although the three key grooves 52 and the three keys 53 are provided, it is sufficient if at least two key grooves and two keys are provided, and four or more such components may be provided.

The thermal conductive sheet 22 is attached to the upper surface of the cap member 29. The thermal conductive sheet 22 is for efficiently conducting the heat from the lamp device 14 to the equipment main body 12 side when the lamp device 14 is mounted on the equipment main body 12. The thermal conductive sheet 22 has a multi-layer structure of, for example, a silicone sheet having elasticity and attached to the cap member 29 and a metal foil attached to the upper surface of the silicone sheet and made of aluminum, tin, zinc or the like, and is formed into a polygon such as a hexagon or a circle. The friction resistance of the surface of the metal foil is low as compared with the silicone sheet.

The light-emitting module 23 includes a board 55, a light-emitting part 56 formed on the lower surface of the board 55, and a connector 57 mounted on the lower surface of the board 55.

The board 55 is made of a material, such as metal excellent in thermal conductivity or ceramic, and is formed into a quadrangular flat-plate shape which can be fitted in the concave part 45 of the holder part 43. Positioning concave parts 58 which are fitted to the respective positioning projections 47 of the holder part 43 and performs positioning are formed at four corners of the board 55.

In the light-emitting part 56, a semiconductor light-emitting element 56*a* such as an LED element or an EL element is used as a light source. In this embodiment, the LED element is used as the semiconductor light-emitting element 56*a*, and a COB (Chip On Board) system is adopted in which plural LED elements are mounted on the board 55. That is, the plural LED elements are mounted on the board 55, the plural LED elements are electrically connected in series to each other by wire bonding, and the plural LED elements are integrally covered and sealed with a phosphor layer of transparent resin, such as silicone resin, in which phosphor is mixed. As the LED element, for example, an LED element to emit blue light is used, and a phosphor which is excited by part of the blue light from the LED element and emits yellow light is mixed in the phosphor layer. Accordingly, the light-emitting part 56 is composed of the LED elements, the phosphor layer and the like. The surface of the phosphor layer as the surface of the light-emitting part 56 becomes a quadrangular or circular light-emitting surface, and white illumination light is emitted from the light-emitting surface. Incidentally, as the light-emitting part 56, a system may be used in which plural SMD (Surface Mount Device) packages with connection terminals mounted with LED elements are mounted on the board 55.

The connector 57 is electrically connected to the plural semiconductor light-emitting elements 56*a*, and is connected with an electric wire C having a connector for connection with the lighting circuit 25.

The optical component 24 includes a cylindrical reflector 67. The reflector 67 is formed of, for example, a synthetic resin material having an insulating property. The reflector 67 is provided with a cylindrical light guide part 68 whose upper and lower surfaces are opened and whose diameter is stepwise or continuously increased from an upper end side to a lower end side. An annular cover part 69 to cover the lower surface periphery of the case 28 is formed at the lower end of the light guide part 68. A reflecting surface 70 having a high optical reflectance, such as, for example, a white or mirror surface, is formed on the inner surface of the light guide part 68 and the lower surface of the cover part 69. As a unit configured to form the reflecting surface 70, a unit configured to evaporate aluminum or the like can be used. In this case, an outer peripheral part of the cover part 69 is masked to form a non-evaporation surface, and an electric insulating property can be improved.

An upper part side of the light guide part 68 passes through the lighting circuit 25 (circuit board) and the optical component insertion hole 34 of the case 28. A board fitting part 73 fitted to the lighting circuit 25 (circuit board) is formed on the outer peripheral surface of the light guide part 68 and at an intermediate part in the up-and-down direction. A board holding part 74 to hold the lighting circuit 25 (circuit board) between itself and the board support parts 37, 38 of the case 28 is formed at the board fitting part 73.

Plural holding pawls 75 supported by the respective optical component support parts 40 of the case 28 are formed on the cover part 69. As an example, one of the holding pawls 75 is fitted to the rib 40*a* of one of the optical component support parts 40, and the rotation of the reflector 67 relative to the case 28 is prevented.

The lighting circuit 25 includes, for example, a circuit to rectify and smooth commercial AC power supply voltage, and a DC/DC converter including a switching element to switch at high frequency of several kHz to several hundred kHz, and constitutes a power supply circuit to output DC power of constant current. The lighting circuit 25 includes a circuit board 77 and circuit components 78 as plural electronic components mounted on the circuit board 77.

The circuit board 77 is formed into an annular shape having, at the center part, a circular fitting hole 79 through which the upper side of the light guide part 68 of the reflector 67 passes and in which the board fitting part 73 is fitted. The outer diameter of the circuit board 77 is formed to have such a size that the circuit board is fitted to the board support part 37 of the case 28. A cut-away part 80 corresponding to the wiring path 39 of the case 28 is formed in the edge part of the fitting hole 79.

The lower surface of the circuit board 77 is a mounting surface 77*a* on which a discrete component including a lead wire among the circuit components 78 is mounted, and the upper surface thereof is a wiring pattern surface 77*b* formed with a wiring pattern to which a lead wire of the discrete component is soldered and a surface mount component among the circuit components 78 is mounted.

Among the circuit components 78 mounted on the mounting surface 77*a* of the circuit board 77, at least one of a large component having a large protrusion height from the circuit board 77, a heat generating component having a large amount of heat generation, and a component weak to heat, such as an electrolytic capacitor, or preferably all of them are mounted at a position close to the outside of the circuit board 77. A not-shown connector for connection with the light-emitting module 23 through the electric wire C having the connector is mounted on the mounting surface 77*a* of the circuit board 77 and at a position near the cut-away part 80.

The circuit board 77 is arranged at an upper side in the case 28 in a state where the wiring pattern surface 77*b* parallelly faces the flat plate part 31 of the case 28. The circuit components 78 mounted on the mounting surface 77*a* of the circuit board 77 are arranged between the peripheral surface part 32 of the case 28 and the light guide part 68 and the cover part 69 of the reflector 67.

A pair of lamp pins 81 electrically connected to the circuit board 77 are press-inserted in the lamp pin insertion holes 36 of the case 28, and are vertically protruded upward from the case 28. That is, the pair of lamp pins 81 vertically protrudes from the upper surface of the cap 30. The lamp pins 81 may be electrically connected to the circuit board 77 by lead wires, or the lamp pins 81 may be standingly provided on the circuit board 77 and directly connected to the circuit board 77.

The translucent cover 26 has a transparent property and a diffusion property, and is formed of, for example, synthetic resin or glass into a disk shape. The translucent cover 26 covers the opening part 28*a* and is attached to the case 28. A fitting part 84 to be fitted to the inner periphery of the peripheral surface part 32 of the case 28 is formed on the upper surface peripheral part of the translucent cover 26, and plural locking pawls 85 locked with the respective projections 41 of the peripheral surface 32 of the case 28 are formed on the fitting part 84. In the state where the respective locking pawls 85 are locked with the projections 41, the respective holding pawls 75 of the reflector 67 are sandwiched and held between the fitting part 84 and the respective optical component support parts 40. Incidentally, the optical component support parts 40 of the case 28 are not used (in this case, instead of the optical component support parts 40, a reinforcing rib may be used), and the optical component 24 may be sandwiched and held between the fitting part 84 of the translucent cover 26 and the circuit board 77.

A pair of finger-hooking parts 86 for facilitating an attachment and detachment operation of the lamp device 14 to and from the equipment main body 12 are provided to protrude from the peripheral part of the lower surface of the translucent cover 26, and a triangular mark 87 indicating a mount position to the equipment main body 12 is formed. The shape of the finger-hooking part 86 is arbitrary, and is preferably a shape which does not impair the outer appearance (nor noticeable), does not disturb the luminous intensity distribution, and eases the operation at the time of attachment and detachment of the lamp device 14 as described later.

In the lamp device 14 constructed as stated above, the lighting circuit 25 is arranged in the case 28, the light-emitting module 23 is arranged in the cap member 29 not at the position of the lighting circuit 25 in the case 28, but at the position of the cap 30 side, and the light-emitting module 23 is thermally connected and attached to the cap member 29. Besides, the light guide part 68 of the reflector 67 is arranged in the fitting hole 79 of the circuit board 77 and the optical component insertion hole 34 of the case 28, and the cover part 69 of the reflector 67 covers and conceals the lighting circuit 25.

Incidentally, in the lamp device 14 of the embodiment, for example, the input power (power consumption) of the light-emitting module 23 is 20 to 25 W, and the total light flux is 1100 to 1650 μm.

Next, as shown in FIG. 5, the equipment main body 12 includes a reflector 91 expanded and opened downward, a thermal radiator 92 attached to an upper part of the reflector 91, an attachment plate 93 attached to an upper part of the thermal radiator 92, and plural attachment springs 94 for ceiling attachment provided on the thermal radiator 92. A circular opening 91*a* is formed at the top of the reflector 91. A contact surface 92*a* facing the inside of the reflector 91 through the opening 91*a* of the reflector 91 is formed on the thermal radiator 92. A terminal stand 95 is attached to the attachment plate 93.

The socket 13 is formed into an annular shape. A pair of connection holes 97 (FIG. 5 shows only one of them, and the other is concealed by the reflector 91) are formed into a long-hole shape along the circumferential direction in the lower surface of the socket 13. Plural substantially L-shaped attachment grooves 98 and plural attachment protrusions 99, which are used to detachably attach the lamp device 14 by rotating the lamp device, are alternately formed on the inner peripheral surface of the socket 13 at equal intervals in the circumferential direction. The respective attachment grooves 98 and the respective attachment protrusions 99 correspond to the respective keys 53 and the key grooves 52 of the lamp device 14, and the lamp device 14 can be detachably attached to the socket 13. Besides, not-shown terminals are respectively arranged on the insides of the pair of connection holes 97, and the commercial AC power supply is supplied to the pair of terminals through the terminal stand 95.

Next, the assembly of the lamp device 14 will be described.

The electric wire C having the connector connected to the connector 57 of the light-emitting module 23 is inserted into the case 28 through the optical component insertion hole 34 of the case 28, and the light-emitting module 23 is fitted and attached to the holder part 43 of the case 28. At this time, the respective positioning concave parts 58 at the four corners of the board 55 of the light-emitting module 23 are fitted to the respective positioning projections 47 at the four corners of the holder part 43, and the board 55 is fitted in the concave part 45 of the holder part 43, so that the light-emitting module 23 is positioned and held in the holder part 43. Since the holder part 43 is positioned and held in the case 28, the light-emitting module 23 is positioned and held in the case 28 through the holder part 43. In the state where the light-emitting module 23 is fitted and held in the holder part 43, the light-emitting part 56 and the connector 57 are arranged in the opening 46 of the holder part 43, and the upper side of the board 55 is at a higher position than the concave part 45 and protrudes from the upper surface of the holder part 43.

The respective keys 53 of the cap member 29 are fitted to the respective key fitting grooves 42 of the protrusion part 33 of the case 28, and the cap member 29 is put on the protrusion part 33 of the case 28. The respective screws 49 are screwed into the respective attachment holes 50 of the cap member 29 through the screw insertion holes 35*a* of the respective bosses 35 of the case 28, and the case 28 and the cap member 29 are tightened and fixed by the respective screws 49. By this, the board 55 of the light-emitting module 23 is sandwiched between the holder part 43 of the case 28 and the light-emitting module attachment part 51 of the cap member 29, the board 55 is press-contacted to the contact surface 51*a* of the light-emitting module attachment part 51, and excellent thermal conductivity from the board 55 to the cap member 29 is obtained. Incidentally, the thermal conductive sheet (reference character S in FIG. 1) to enhance thermal conductivity or a thermal conductive member such as thermal conductive grease is interposed between the board 55 of the light-emitting module 23 and the light-emitting module attachment part 51 of the cap member 29.

Accordingly, the case 28 and the cap member 29 can be tightened and fixed by the screws 49, and the board 55 of the light-emitting module 23 can be sandwiched and fixed between the holder part 43 of the case 28 and the light-emitting module attachment part 51 of the cap member 29. The screws 49 can be used also for fixing these.

The lamp pins 81 are press-inserted in the case 28, and the lighting circuit 25 is inserted in the case 28. With respect to the lighting circuit 25, the peripheral part of the circuit board 77 is fitted to the board support part 37 of the case 28, and the upper surface of the circuit board 77 on the inner peripheral side is brought into contact with the board support part 38. Besides, when the lighting circuit 25 is inserted in the case 28, the electric wire C having the connector is drawn through the wiring path 39 of the case 28, and the electric wire C having the connector is connected to the connector of the circuit board 77.

The reflector 67 is inserted in the case 28, and the light guide part 68 of the reflector 67 is inserted in the fitting hole 79 of the circuit board 77 and the optical component insertion hole 34 of the case 28. The board fitting part 73 of the light guide part 68 is fitted in the fitting hole 79 of the circuit board 77, and the board holding part 74 of the light guide part 68 is brought into contact with the circuit board 77. The tip of the light guide part 68 is fitted to the holder part 43. Besides, the holding pawls 75 of the reflector 67 are arranged at the positions facing the optical component support parts 40 of the case 28.

The translucent cover 26 is fitted in the opening 28*a* of the case 28, and the locking pawls 85 of the translucent cover 26 are locked with the projections 41 of the case 28. By this, the fitting part 84 of the translucent cover 26 contacts the holding pawls 75 of the reflector 67 and presses the holding pawls to the optical component support parts 40, and the holding pawls 75 are sandwiched and held between the fitting part 84 and the optical component support parts 40. Further, the board holding part 74 of the reflector 67 presses the circuit board 77 to the board support parts 37 and 38, and the circuit board 77 is sandwiched and held between the board holding part 74 and the board support parts 37 and 38.

Accordingly, the translucent cover 26 is attached to the case 28, so that the circuit board 77 and the reflector 67 are sandwiched and held between the case 28 and the translucent cover 26.

Next, the mounting of the lamp device 14 on the luminaire 11 will be described.

First, the lamp device 14 is inserted to the socket 13 from the lower opening of the equipment main body 12. That is, the cap member 29 of the lamp device 14 is inserted into the inside of the socket 13, and the respective key grooves 52 of the cap member 29 are fitted to the attachment protrusions 99 of the socket 13. Further, the respective keys 53 of the cap member 29 are inserted in the respective attachment grooves 98 of the socket 13, and the respective lamp pins 81 of the lamp device 14 are inserted in the respective connection holes 97 of the socket 13. By this, the upper surface of the cap member 29 contacts the contact surface 92*a* of the thermal radiator 92 through the thermal conductive sheet 22.

Next, in the state where the lamp device 14 is pressed to the thermal radiator 92, the lamp device 14 is rotated in the mounting direction by a specified angle. When the lamp device 14 is rotated and operated, even if a space which a finger enters is small between the peripheral surface of the lamp device 14 and the equipment main body 12, the lamp device 14 can be easily rotated and operated by hooking the finger on the finger-hooking part 86 protruding from the lower surface of the translucent cover 26.

The lamp device 14 is rotated in the mounting direction, so that the respective key grooves 52 of the cap member 29 rotate from the positions of the respective attachment protrusions 99 of the socket 13, and the peripheral part of the cap member 29 is hooked on the attachment protrusions 99. Further, the respective keys 53 of the cap member 29 are hooked on the respective attachment grooves 98 of the socket 13, and the lamp device 14 is attached to the socket 13. Besides, the respective lamp pins 81 of the lamp device 14 move in the respective connection holes 97 of the socket 13, contact the respective terminals arranged in the respective connection holes 97, and are electrically connected.

In the mount state of the lamp device 14, the upper surface of the cap member 29 of the lamp device 14 is in close contact with the contact surface 92*a* of the thermal radiator 92 through the thermal conductive sheet 22, and heat can be efficiently conducted from the lamp device 14 to the thermal radiation 92.

When the lamp device 14 is detached from the luminaire 11, first, the lamp device 14 is rotated in the detachment direction opposite to the direction at the time of mounting the lamp device 14, so that the respective key grooves 52 of the cap member 29 move onto the respective attachment protrusions 99 of the socket 13, and the respective keys 53 of the cap member 29 move to the positions where the keys are detached from the respective attachment grooves 98 of the socket 13. Next, the lamp device 14 is moved downward, so that the respective lamp pins 81 are detached from the respective connection holes 97 of the socket 13, the respective key grooves 52 of the cap member 29 are detached from the respective attachment protrusions 99 of the socket 13, and the respective keys 53 of the cap member 29 are detached from the respective attachment grooves 98 of the socket 13. Further, the cap member 29 is detached from the inside of the socket 13, and the lamp device 14 can be detached from the socket 13.

Next, the lighting of the lamp device 14 will be described.

When electric power is applied from a power line to the lighting circuit 25 through the terminal stand 95, the terminal of the socket 13, and the lamp pin 81 of the lamp device 14, the lighting circuit 25 supplies lighting power to the semiconductor light-emitting elements 56*a* of the light-emitting module 23, and the semiconductor light-emitting elements 56*a* are lit. The light emitted from the light-emitting part 56 by lighting the semiconductor light-emitting elements 56*a* travels in the light guide part 68 of the reflector 67, passes through the translucent cover 26, and outgoes from the lower opening of the equipment main body 12.

Besides, at the time of lighting, heat generated by the semiconductor light-emitting elements 56*a* of the light-emitting module 23 is mainly efficiently conducted to the thermally connected light-emitting module attachment part 51 of the cap member 29 from the board 55 of the light-emitting module 23. Further, the heat is efficiently conducted from the light-emitting module attachment part 51 of the cap member 29 through the thermal conductive sheet 22 to the closely contacted thermal radiator 92, and the heat is radiated to the air from surfaces including plural thermal radiation fins of the thermal radiator 92.

Besides, part of the heat conducted from the lamp device 14 to the thermal radiator 92 is conducted also to the equipment main body 12, the plural attachment springs 94 and the attachment plate 93, and is radiated to the air from these.

Besides, heat generated by the lighting circuit 25 is conducted to the case 28 and the translucent cover 26, and is radiated to the air from the surfaces of the case 28 and the translucent cover 26.

As described above, according to the lamp device 14 of the embodiment, since the light-emitting module 23 is held by the holder part 43 of the case 28, and is sandwiched and fixed between the holder part 43 of the case 28 and the cap member 29, a fixing component for fixing the light-emitting module 23 to the cap member 29 is not required. Thus, the number of components can be reduced and the assembling property can be improved.

Besides, the holder part 43 is formed separately from the case 28, and is combined and integrated with the case 28. Thus, for example, when the height of the light-emitting module attachment part 51 of the cap member 29 is changed according to the change of the type of the light-emitting module 23 or the luminous intensity distribution control, the change can be coped with by changing the holder part 43 to be combined with the case 28, and the case 28 can be made common.

Figure 6:
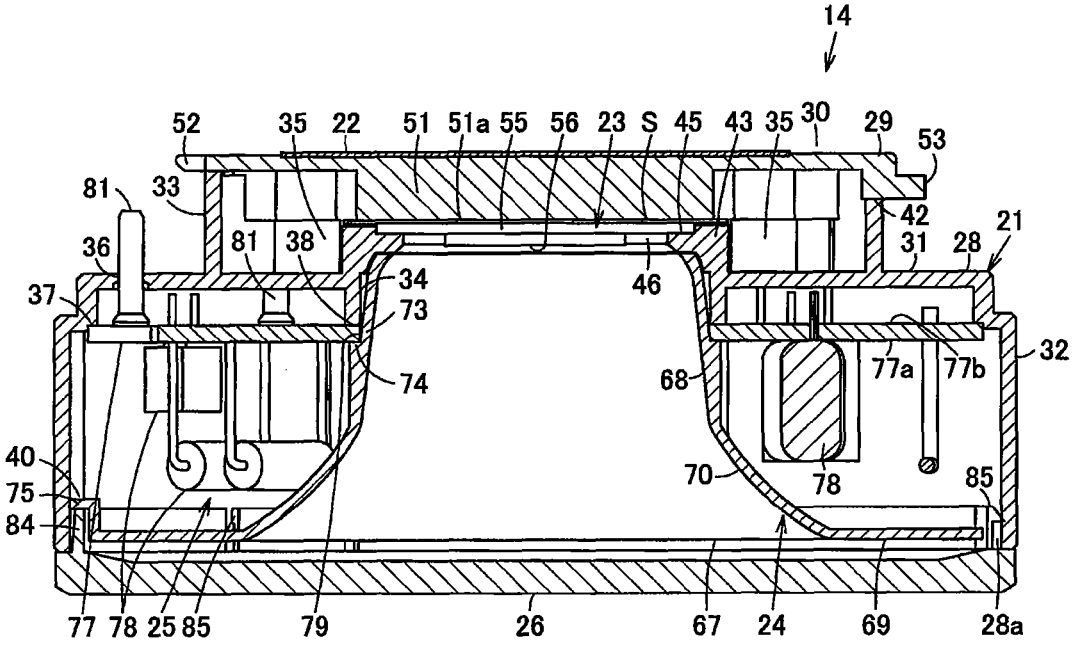
FIG. 6 is a sectional view of a lamp device of a second embodiment.

Besides, as in a second embodiment shown in FIG. 6, a holder part 43 may be formed integrally with a case 28. When the holder part 43 is formed integrally with the case 28, the number of components can be reduced and the assembling property can be improved.

Incidentally, a concave part or a convex part to position and hold the board 55 of the light-emitting module 23 may be provided on the light-emitting module attachment part 51 of the cap member 29.

Besides, the fixing unit 48 is not limited to the screw 49, and may have a locking structure to fix by hooking a pawl or a screwing structure.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. A lamp device comprising:

a light-emitting module including a substrate and a semiconductor light-emitting element mounted on the substrate;

a housing that includes a case including a holder part to hold the substrate, and a cap member fixed to the case by a fixing unit, the cap member having a protruding part with a flat contact surface that is in thermal contact with the substrate and sandwiches the substrate against the holder part; and a lighting circuit that is housed in the housing and controls the lighting of the semiconductor light-emitting element.

2. The device of claim 1, wherein the substrate is positioned by the holder part.

3. The device of claim 1, wherein the substrate is held within a groove in the holder part, a thickness of the substrate being larger than the depth of the groove.

4. The device of claim 1, wherein the holder part and the case are integral with each other.

5. The device of claim 1, further comprising a reflector to reflect light emitted by the light-emitting module, wherein the reflector is also held by the holder part.

6. A luminaire comprising:

an equipment main body including a socket; and a lamp device according to claim 1 mounted in the socket.

* * * * *